United States Patent [19]

Stenberg

[11] Patent Number: 4,525,882

[45] Date of Patent: Jul. 2, 1985

[54] BATH-TUB TRAY

[76] Inventor: Inga E. Stenberg, Erik Dahlbergsgatan 27, S-115 32 Stockholm, Sweden

[21] Appl. No.: 663,486

[22] Filed: Oct. 22, 1984

[30] Foreign Application Priority Data

Nov. 18, 1983 [SE] Sweden ..... 8306371

[51] Int. Cl.[3] ..... A47K 3/00

[52] U.S. Cl. ..... 4/559; 4/656; 4/605; 211/184; 108/137

[58] Field of Search ..... 4/559, 661, 577, 605, 4/656; 211/184; 138/116; 108/137

[56] References Cited

U.S. PATENT DOCUMENTS

| | | | |
|---|---|---|---|
| 801,275 | 10/1905 | Silk | 4/656 X |
| 958,857 | 5/1910 | Dennis | 4/656 X |
| 1,830,347 | 11/1931 | Camden et al. | 108/137 |
| 2,591,467 | 4/1952 | Rodefer | 4/656 X |
| 2,645,127 | 7/1953 | Parks | 211/184 X |
| 2,659,491 | 11/1953 | Williams | 4/559 X |
| 2,678,045 | 5/1954 | Erhard | 211/184 X |
| 2,768,043 | 10/1956 | Kristoff et al. | 108/137 X |
| 3,213,565 | 10/1965 | Grosz | 4/559 X |
| 3,484,226 | 12/1969 | Golightly | 211/184 X |
| 4,155,312 | 5/1979 | Thorkildson | 108/137 |

*Primary Examiner*—Henry K. Artis

*Attorney, Agent, or Firm*—Cushman, Darby & Cushman

[57] ABSTRACT

A bath-tub tray has arranged on the inner surfaces of its longitudinally extending walls (3,4) grooves (e.g. 11,12) intended to receive a clamping plate (19), having a lower part (21) arranged to be inserted through a slot (17) in the bottom (2) of the tray and to clamp against the inner surface of the bath-tub. Preferably, both end portions of the tray (1) are provided with grooves, slots and clamping plates, although it is possible to provide one end of the tray with a permanently fixed, resilient plate which projects from the bottom (2) of the tray.

3 Claims, 2 Drawing Figures

BATH-TUB TRAY

The invention relates to a bath-tub tray of the kind which is intended to be placed across a bath-tub and to support soap, brushes and like articles, and the length of which is such that the ends of said tray extend over the longitudinally extending, substantially horizontal edge surfaces of said bath-tub.

Bath-tub trays of this kind, which are normally made of a plastics material and moulded in one piece, possess two serious disadvantages, namely that they rest against the side-edges of the bath-tub under their own, relatively insignificant weight, and that when the bath-tub is filled ready for use, the bottoms of said trays, which bottoms are normally perforated, lie too close to the surface of the water.

The first disadvantage means that the tray can be readily dislodged, for example, by knocking the same with a knee, and fall into the water, together with the articles resting upon the tray, while the second disadvantage normally means that the articles resting on the tray lie more or less constantly in water.

Even though bath-tubs have been standardized to a very high degree, the bath-tubs still differ in width, which means that the various bath-tub trays must be adapted to suit bath-tubs of different manufacture. This is difficult to put into effect from the aspect of economy, which means that a compromise must be made, by arranging the stop members on the tray bottoms for preventing longitudinal displacement of the tray in a manner which suits the majority of bath-tubs. In practice, this means that the tray can normally be moved sideways some few centimeters, which further increases the risk of the tray being knocked into the bath water unintentionally.

Consequently, a prime object of the invention is to provide a bath-tub tray which is held safely on the bath-tub, irrespective of variations in the widths of such tubs, and which enables the tray to be securely clamped with the bottom of the tray located well above the surface of the water.

Figure 1:
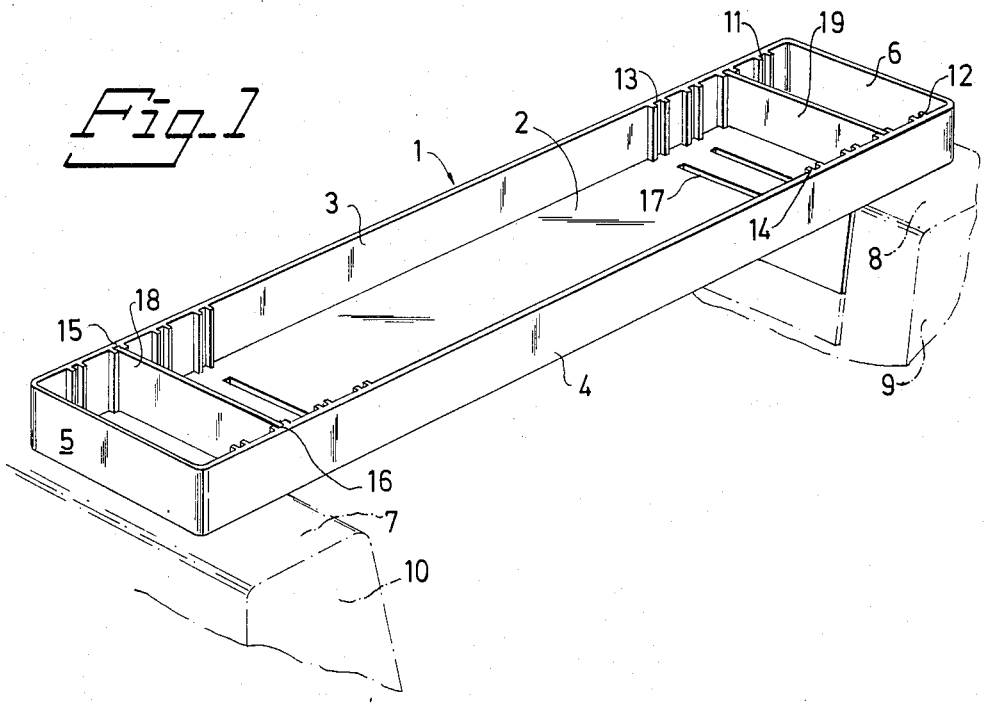
Figure 2:
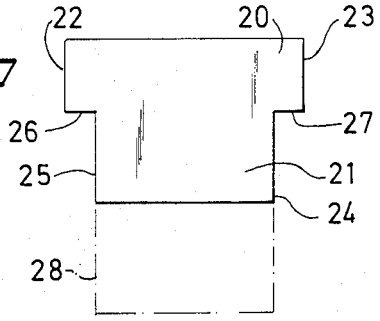

This object is fully achieved by means of the invention, which is described hereinafter with reference to the accompanying drawing, in which FIG. 1 is a perspective illustration of a preferred embodiment of the invention, fitted to a bath-tub; and FIG. 2 illustrates a clamping means.

In the illustrated embodiment according to the invention the bath-tub tray 1 has a bottom 2, two side members 3 and 4 which extend substantially vertically from the bottom 2, and two short sides 5 and 6. The tray 1 is of a length such that its end portions project over the substantially horizontal surfaces 7 and 8 of the bath-tub, on the longitudinally extending bath-tub sides 9 and 10. Arranged on both end portions of the longitudinally extending sides 3 and 4 of the bath-tub tray 1 are pairs of grooves, for example, the groove pairs 11,12; and 13,14 and 15,16. In the illustrated embodiment the grooves are defined by two flanges located on respective tray walls, and extend perpendicularly down towards the planar bottom 2, although said grooves may also be inclined relative to the bottom 2, in order to provide the desired clamping action, as hereinafter described. In the illustrated embodiment, each end portion has arranged thereon four groove pairs, the grooves of each pair lying in planes which are substantially perpendicular to the sides 3 and 4. Between each groove pair, for example the groove pair 13,14, in the bottom 2 of the tray there is located a through-passing slot 17. The ends of the slots 17 terminate slightly in front of their associated grooves, and the length of said slots is thus shorter than the width of the bottom 2. The illustrated tray has two plate-like clamping means 18, 19. As will be seen from FIGS. 1 and 2, each plate-like clamping means has a broad portion 20 and a narrower portion 21, these plate portions having an elongated rectangular shape. The distance between the outer edges 22,23 of the broad plate-portion is such as to enable said edge portions to fit into a groove pair, while the distance between the outer edges 24,25 of the narrower plate-portion is adapted to the length of the slot 17. When a plate has been pushed fully home in the tray, the lower edge portions 26 and 27 of the broader plate-portion 20 will rest against the bottom 2 of the tray 1 and prevent the clamping plate from falling out.

When a plate, for example, the plate 18 has been placed into a suitable position, the next plate 19 is pushed into the groove pair which suits the width of the bath-tub, and the plate portions 21 projecting from the bottom 2 of the tray will therewith be firmly clamped and deflect slightly inwardly towards the centre of the bath-tub. By extending the lower plate portions 21, as indicated in FIG. 2 in chain lines, a requisite clamping force can be obtained against the bottom 2 of the tray 1 in a position above and at a distance from the edge surfaces 7 and 8, thereby obviating the risk of water entering the tray 1 from the bath-tub. As will be understood, it is possible to arrange a movable clamping plate solely at one end portion, for example, the right-hand end portion in FIG. 1, and to arrange a permanently secured tongue-like member, corresponding to the lower portion 21 of the plate 18, on the left-hand end of the tray. The bottom 2 of the tray 1 can be perforated with holes or slots along the whole of its length, to enable any water collecting in the tray, for example from a wet bath brush, to run out of the tray into the bath water.

I claim:

1. bath-tub tray (1) intended to be placed across a bath-tub and to support soap, brushes and like articles, the length of said tray being such that the ends thereof extend over the longitudinally extending, substantially horizontal edge surfaces (7,8) of the bath-tub, characterized in that the mutually opposing, longitudinally extending walls (3,4) of the tray are provided at at least one end portion of said tray with mutually opposing pairs of grooves (11,2; 13,14; 15,16) which extend towards the bottom of the tray; in that the tray bottom (2) is provided with slots (17) which extend between respective groove pairs and which are shorter than the distance between the two grooves in each groove pair; in that there is provided at least one resilient plate (18,19) comprising an upper broad portion (20) and a lower narrower portion (21), said broad plate portion (20) being intended to be inserted into and firmly held between the grooves of the one groove pair, and the narrower portion (21) being intended to be inserted down through the co-acting slot (17) and to lie resiliently against one inner wall of the bath-tub in a clamping fashion; and in that provided at the other end of the tray is a resilient clamping means which projects out from the bottom of the tray and which is arranged to lie against the other inner wall of the bath-tub.

2. A bath-tub tray according to claim 1, characterized in that the two end portions of the tray (1) are provided with said grooves (11,12; 13,14; 15,16) and slots (17); and in that the clamping means (18) also comprises a resilient plate.

3. A bath-tub tray according to claim 2, characterized in that the narrower portions (21) of the two plates have a length such that the tray (1) can be firmly clamped to the bath-tub with the bottom (2) of the tray located at a distance from the edge surfaces (7,8) of the bath-tub.

* * * * *